US010688011B1

(12) United States Patent
Liu

(10) Patent No.: US 10,688,011 B1
(45) Date of Patent: Jun. 23, 2020

(54) FOLDABLE WALKER

(71) Applicant: HOMECARE ENTERPRISE CO., LTD., Changhua (TW)

(72) Inventor: Shih Chieh Liu, Changhua (TW)

(73) Assignee: HOMECARE ENTERPRISE CO., LTD., Changhua (TW)

( * ) Notice: Subject to any disclaimer, the term of this patent is extended or adjusted under 35 U.S.C. 154(b) by 0 days.

(21) Appl. No.: 16/210,799

(22) Filed: Dec. 5, 2018

(51) Int. Cl.
*A61H 3/04* (2006.01)
*A61H 3/00* (2006.01)

(52) U.S. Cl.
CPC ..... *A61H 3/00* (2013.01); *A61H 3/04* (2013.01); *A61H 2201/0161* (2013.01)

(58) Field of Classification Search
CPC ..... A61H 2201/0161; A61H 3/00; A61H 3/04
USPC ..... 135/67, 74–76; 482/66–68
See application file for complete search history.

(56) References Cited

U.S. PATENT DOCUMENTS 2,996,070 A * 8/1961 Ries ..... A61H 3/00 135/67
4,640,301 A * 2/1987 Battiston, Sr. ..... A61H 3/00 135/67
5,188,139 A * 2/1993 Garelick ..... A61H 3/00 135/67
5,529,425 A * 6/1996 Spies ..... A61H 3/00 135/74
7,497,226 B2 * 3/2009 Li ..... A61H 3/00 135/67
7,651,649 B2 * 1/2010 Obitts ..... A61H 3/00 264/242
7,703,465 B2 * 4/2010 Diamond ..... A45B 7/00 135/67
7,726,327 B2 * 6/2010 Battiston ..... A61H 3/04 135/66
9,700,479 B2 * 7/2017 Tsai ..... A61H 3/04
2006/0278260 A1 * 12/2006 Su ..... A45B 7/00 135/67
2007/0023073 A1 * 2/2007 Su ..... A61H 3/04 135/67
2007/0199586 A1 * 8/2007 Cheng ..... A61H 3/04 135/67

* cited by examiner

*Primary Examiner* — Winnie Yip

(57) ABSTRACT

A foldable walker has a connecting rod, two flipping members and two side frames. When the walker is folded, the knob is of the flipping member is rotated to achieve the positioning and disengagement state of the limiting shaft, and the folding/unfolding operation is simple and convenient which greatly improves the practicability of the structure.

5 Claims, 7 Drawing Sheets

A-A

FOLDABLE WALKER

BACKGROUND OF INVENTION

1. Field of Invention

The present invention relates to a walker, and more particularly to a foldable walker.

2. Description of the Related Art

For people with disabilities or older people, walking can be a burden. Therefore, in order to assist disabled people or older people to walk as normal people, walkers are the best choices.

Foldable walkers are commonly used in order to save storage space and carry. However, current walker design is difficult to be folded, which can be very inconvenient for disabled people.

Therefore, it is desirable to provide a foldable walker to mitigate and/or obviate the aforementioned problems.

SUMMARY OF THE INVENTION

An objective of present invention is to provide a foldable walker, which is capable of improving the above-mention problems.

In order to achieve the above mentioned objective, a foldable walker includes a connecting rod, two flipping members and two side frames. Opposing ends of the connecting rod have a respective vertical sleeve, an end of each vertical sleeve has a C-shaped plate with at least one positioning aperture, and another end of the vertical sleeve opposite the positioning aperture has an opening. The two flipping members respectively have a base and a knob. The base has an assembly hole disposed above the C-shaped plate of each vertical sleeve and also has a containing hole for containing an elastic member and a limiting shaft corresponding to the positioning aperture, and a protrusion corresponding to the opening. A rear end of the limiting shaft engages with the positioning aperture. The knob has a through aperture and a grip, and an inclined portion is disposed between the through aperture and the grip. The through aperture of the knob is aligned with the assembly hole of the base. The inclined portion has a curved slot configured to accept the limiting shaft and is connected to a slidable member. The two side frames respectively have a front leg and a rear leg to form a U-shape, and the front leg is disposed through the vertical sleeve of the connecting rod and the flipping member to combine the base of the flipping member with the front leg. The front and rear legs of each side frame further respectively have an elastic clip and is jacketed with an extending leg. Furthermore, a horizontal bar is respectively mounted between the two front legs and the two rear legs of the two side frames.

Other objects, advantages, and novel features of invention will become more apparent from the following detailed description when taken in conjunction with the accompanying drawings.

DETAILED DESCRIPTION OF THE PREFERRED EMBODIMENT

Figure 1:
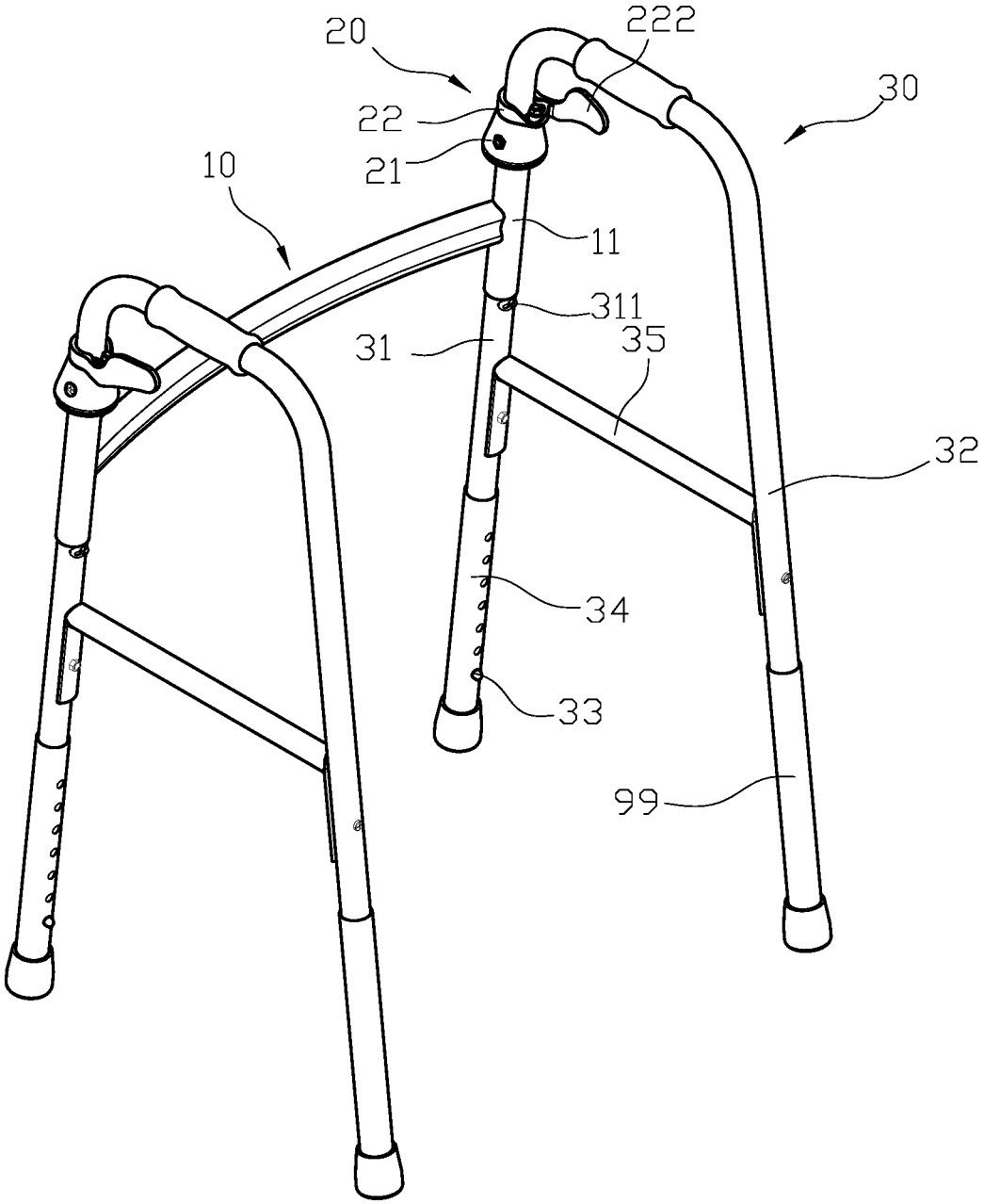
FIG. 1 is a perspective view according to a preferred embodiment of the present invention.
Figure 2:
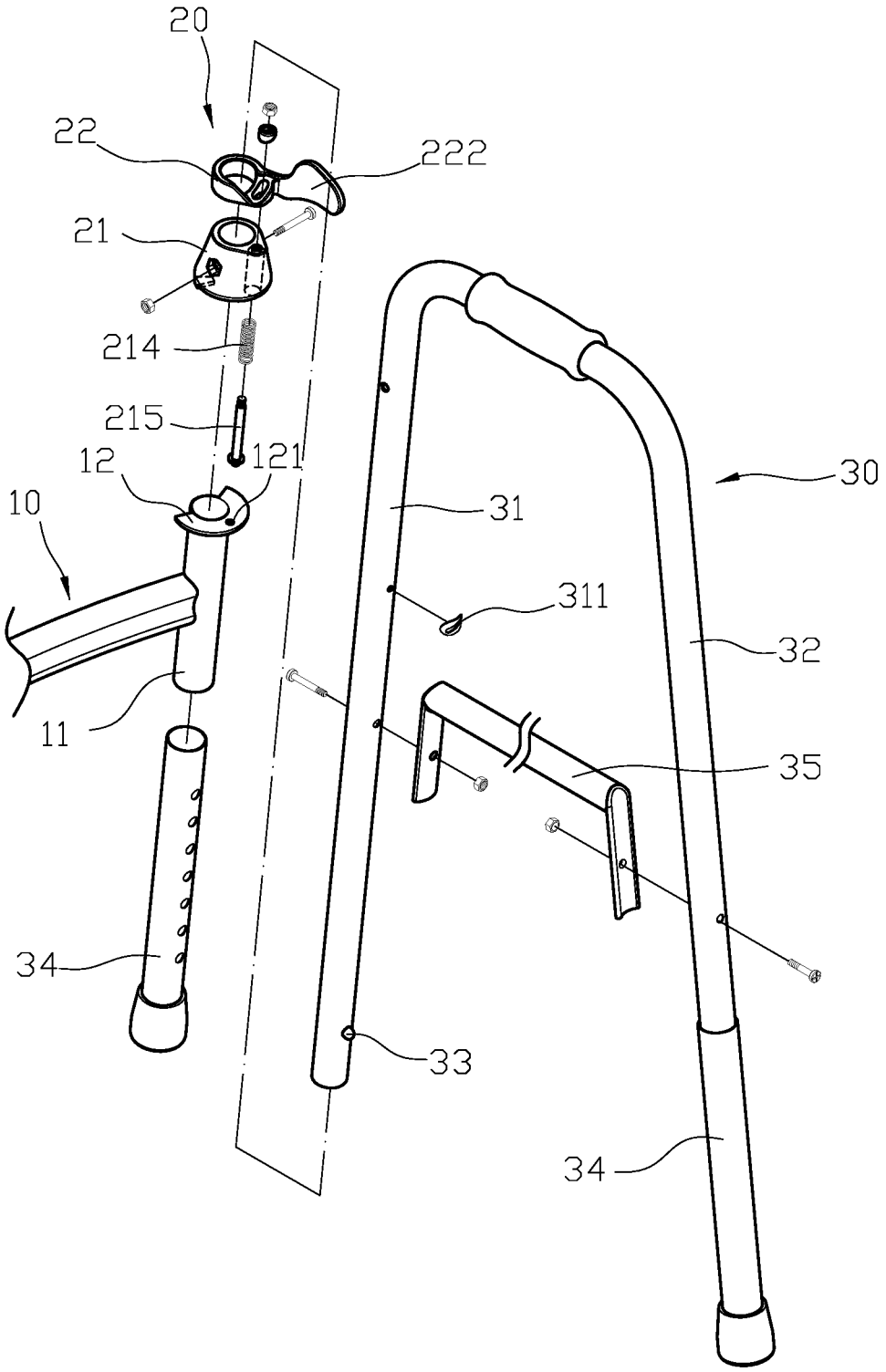
FIG. 2 is an exploded view according to the preferred embodiment of the present invention.
Figure 3:
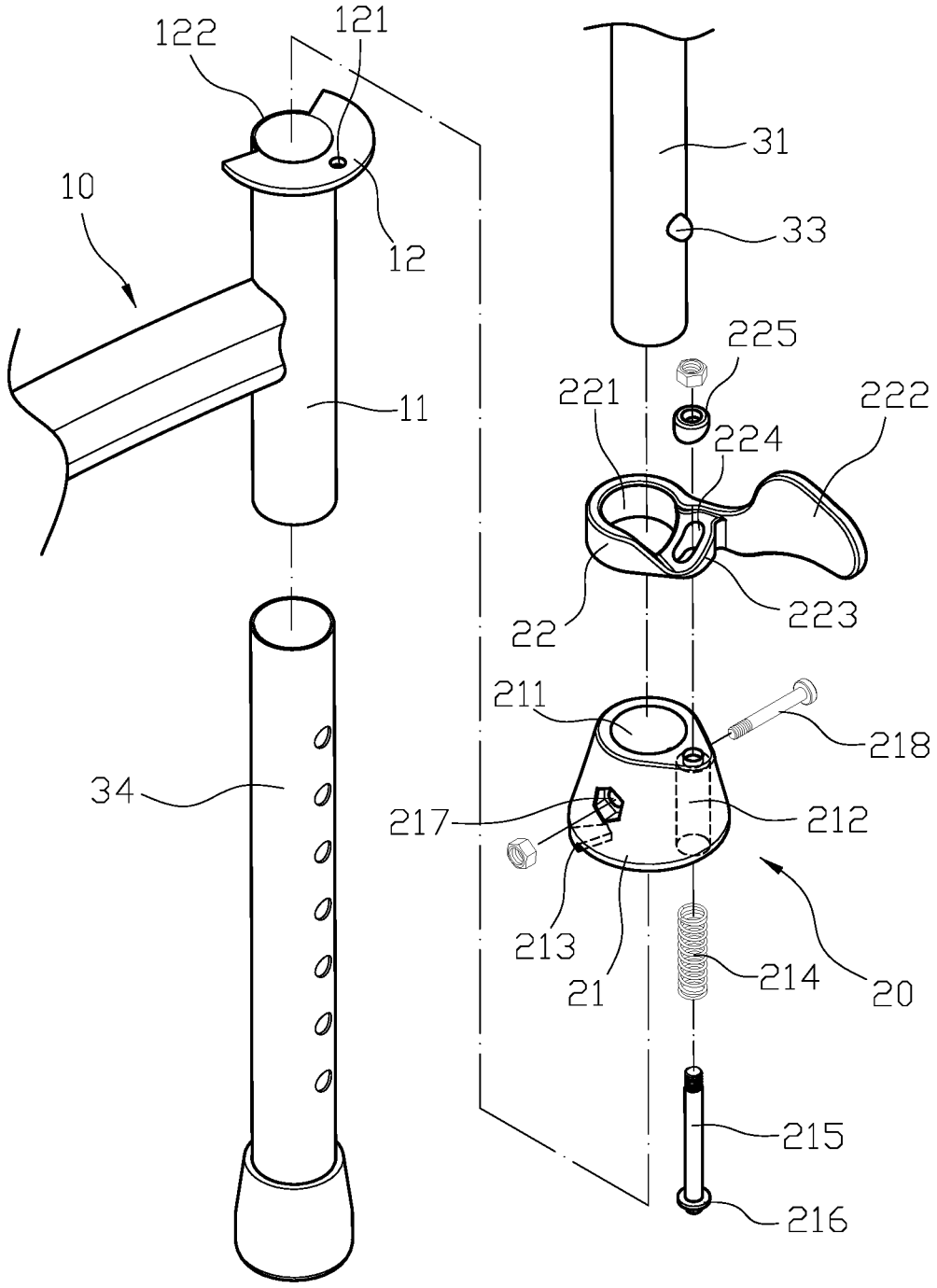
FIG. 3 is a partial enlarged exploded view according to the preferred embodiment of the present invention.

First, please refer to FIGS. 1, 2 and 3. A foldable walker comprises a connecting rod 10, two flipping members 20 and two side frames 30. Opposing ends of the connecting rod 10 have a respective vertical sleeve 11, an end of each vertical sleeve 11 has a C-shaped plate 12 with at least one positioning aperture 121, and another end of the vertical sleeve 11 opposite the positioning aperture 121 has an opening 122. The two flipping members 20 respectively have a base 21 and a knob 22. The base 21 has an assembly hole 211 disposed above the C-shaped plate 12 of each vertical sleeve 11 and also has a containing hole 212 for containing an elastic member 214 and a limiting shaft 215 corresponding to the positioning aperture 121, and a protrusion 213 corresponding to the opening 12. A rear end of the limiting shaft 215 engages with the positioning aperture 121. The knob 22 has a through aperture 221 and a grip 222, and an inclined portion 223 is disposed between the through aperture 221 and the grip 222. The through aperture 221 of the knob 221 is aligned with the assembly hole 211 of the base 21. The inclined portion 223 has a curved slot 224 configured to accept the limiting shaft 215 and is connected to a slidable member 225. The two side frames 30 respectively have a front leg 31 and a rear leg 32 to form a U-shape, and the front leg 31 is disposed through the vertical sleeve 11 of the connecting rod 10 and the flipping member 20 to combine the base 21 of the flipping member 20 with the front leg 31. The front and rear legs 31, 32 of each side frame 30 further respectively have an elastic clip 33 and is jacketed with an extending leg 34. Furthermore, a horizontal 35 bar is respectively mounted between the two front legs 31 and the two rear legs 32 of the two side frames 30.

Figure 4:
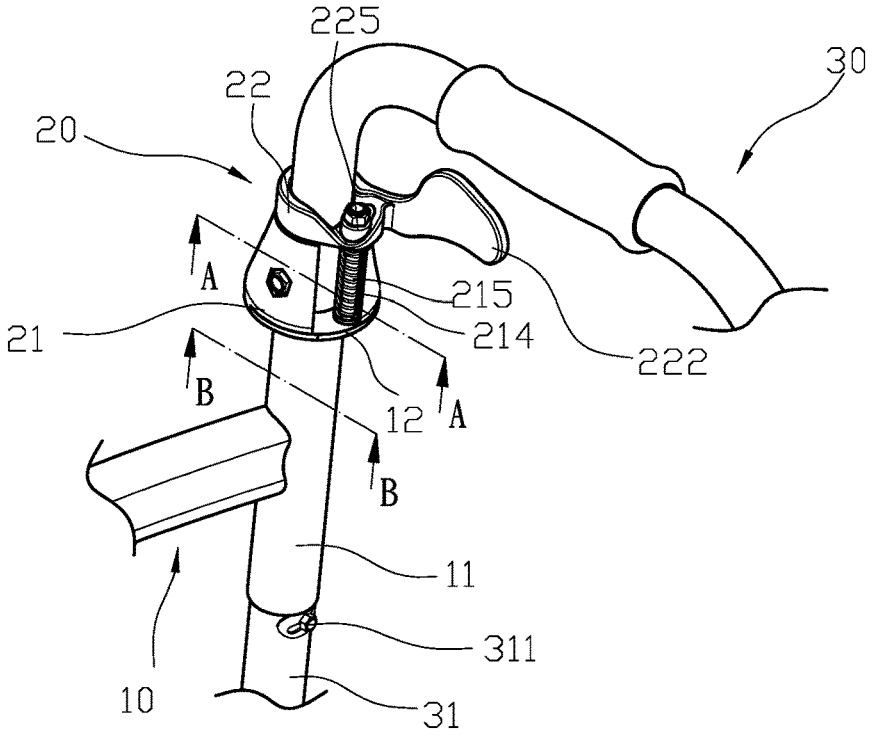
FIG. 4 is another partial enlarged perspective view according to the preferred embodiment of the present invention.
Figure 5:
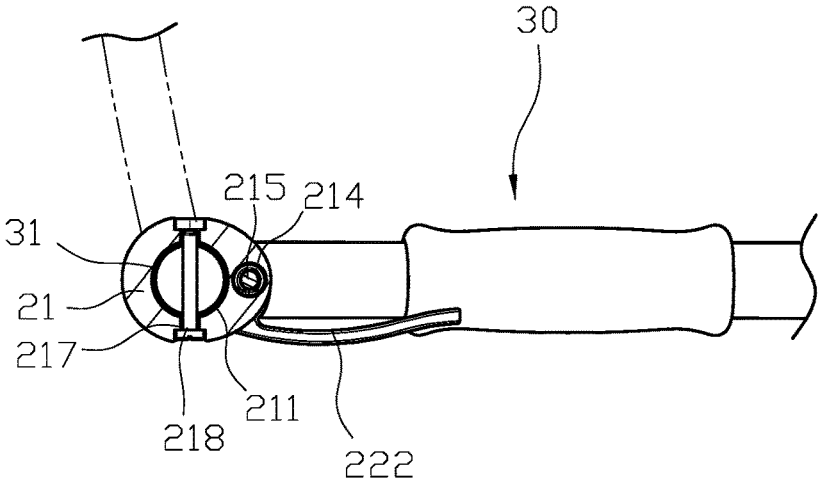
FIG. 5 is a cross-sectional view along the line A-A of FIG. 4 according to the preferred embodiment of the present invention.
Figure 6:
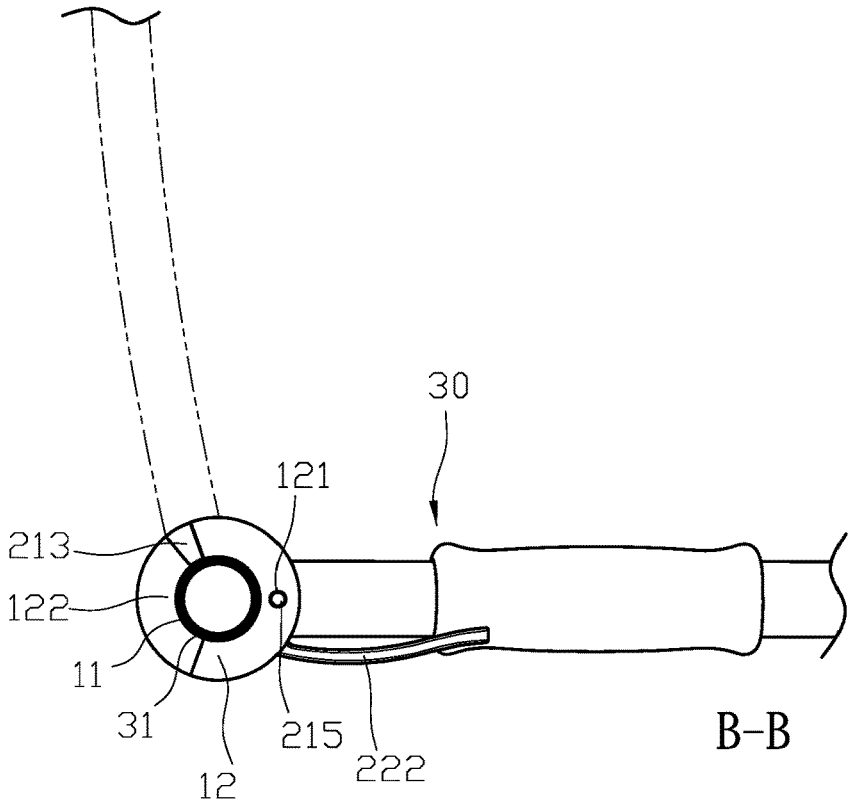
FIG. 6 is a cross-sectional view along line B-B of FIG. 4 according to the preferred embodiment of the present invention.
Figure 7:
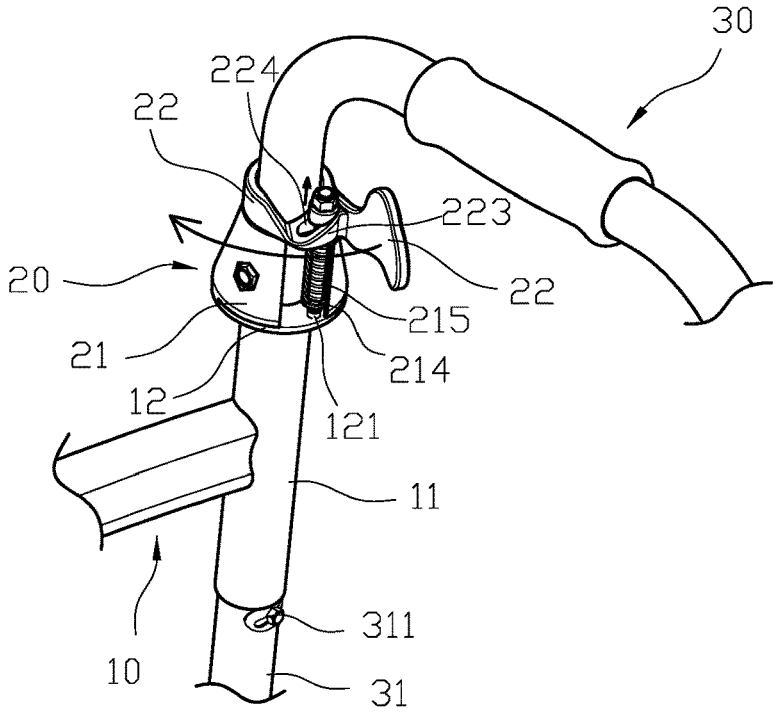
FIG. 7 is a schematic diagram showing when the walker is intended to be folded according to the preferred embodiment of the present invention.
Figure 8:
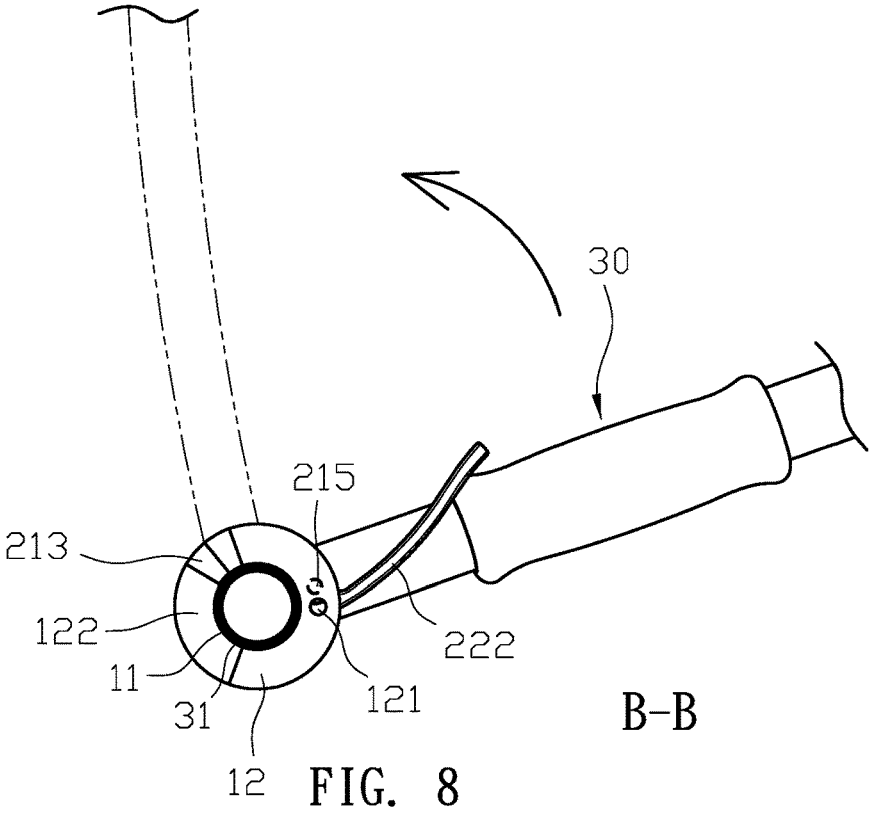
FIG. 8 is the schematic diagram showing the side frame moved toward the connecting rod according to the preferred embodiment of the present invention.
Figure 9:
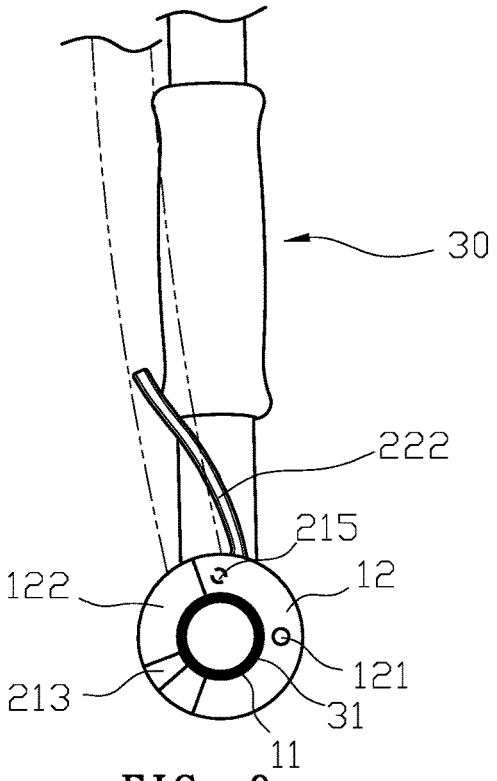
FIG. 9 is the schematic diagram showing the side frame folded onto the connecting rod according to the preferred embodiment of the present invention.
Figure 10:
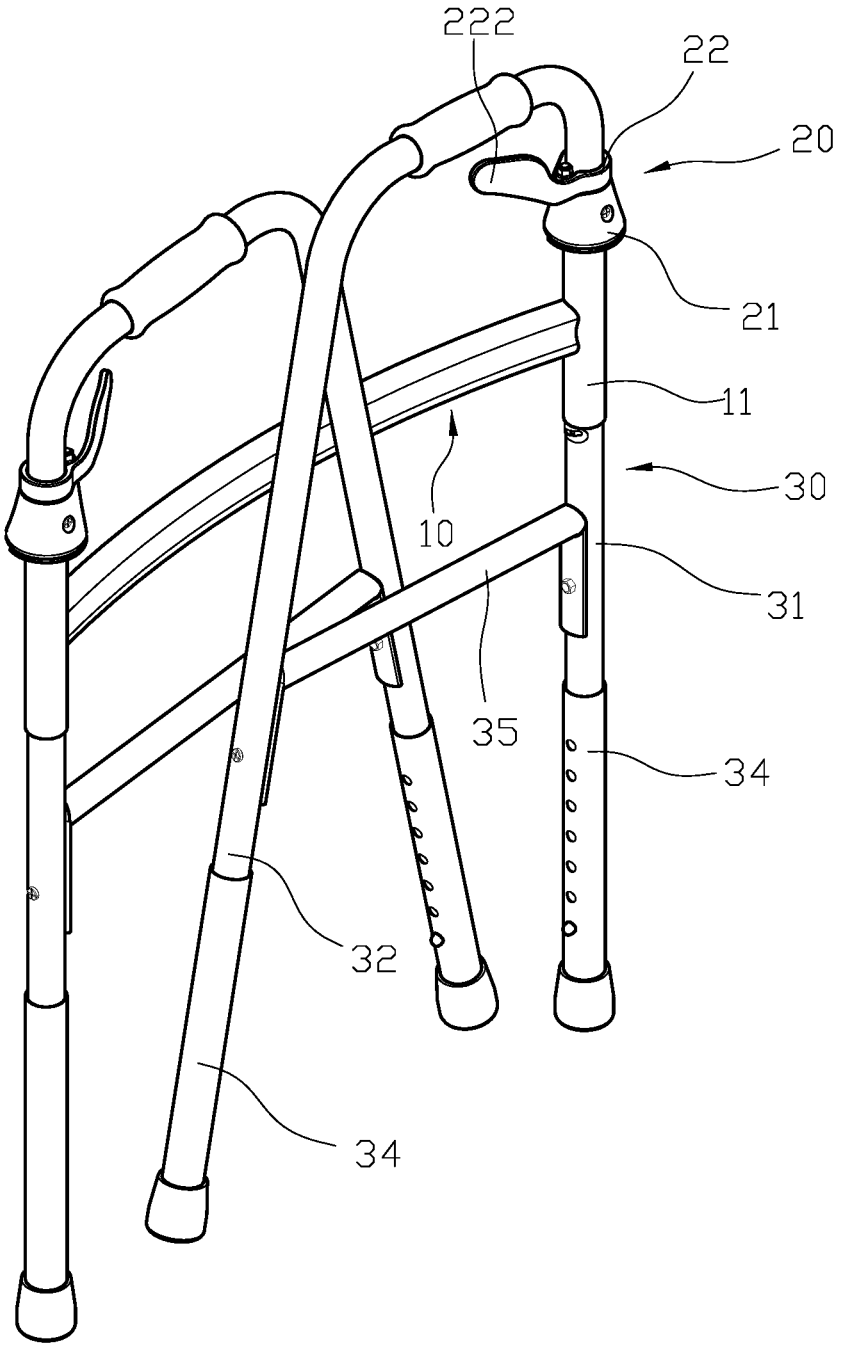
FIG. 10 is a perspective view of the folded walker according to the preferred embodiment of the present invention.

For the structure of the structure, please refer to FIGS. 1, 2, and 3 with FIGS. 4, 5, and 6. The assembly hole 211 of the base 21 and the through aperture 221 of the knob 22 of the flipping member 20 are correspondingly stacked, and the elastic member 214 and the limiting shaft 215 are disposed in the receiving hole 212 from the bottom. A stopping end 216 is disposed at the bottom of the limiting shaft 215 against the elastic member 214, and a top end of the limiting shaft 215 passes through the curved slot 224 of the knob 22, and the slidable member 225 is connected to the inclined portion 223 to be positioned. The base 21 of each two flipping member 20 is stacked above the vertical sleeve 11 of the connecting rod 10, the protrusion 213 at the bottom of the base 21 is limited to the opening 122 of the C-shaped plate 12, and a bottom end of the limiting shaft 215 engages with the positioning aperture 121 of the C-shaped plate 12. The front leg 31 of each side frame 30 passes through the two vertical sleeves 11 of the connecting rod 10 and the two flipping members 20. A stopping member 311 is provided at a middle section of the front leg 31 and configured for setting the vertical sleeve 11. The assembly hole 211 and the through aperture 221 of the base 21 and the knob 22 are configured for accepting the front leg 31, and a through hole 217 provided on the side of the base 21 is aligned with the assembly hole 211, and the base 21 is fixed to the front leg 31 through a securing pin 218.

For actual usage, as shown in FIGS. 7 to 10, when the structure is unfolded, the two side frame 30 is attached to both sides of the connecting rod 10 and are parallel to each other. The protrusion 213 of the base 21 is placed against the end of the opening 122, the limiting shaft 215 utilizes the slidable member 225 to move along the curved slot 224 and being limited to a low end of the inclined portion 223. The elastic member 214 pushes the limiting shaft 215 to extend out from the elastic piercing hole 212 and insert into the positioning aperture 121 of the C-shaped plate 12, therefore the two side frames 30 and the connecting rod 10 are securely connected.

Furthermore, in order to fold the walker, please refer to the FIGS. 7 to 10. The knob 22 of the flipping member 20 is pushed clockwise around the front leg 31, the limiting shaft 215 moves along the curved slot 224 so that the slidable member 225 of the limiting shaft 215 locates at a high end of the inclined portion 223, and the limiting shaft 215 is propped up and disengages from the positioning aperture 121 of the C-shaped plate 12. Therefore, the flipping member 20 disengages from the connecting rod 10 and rotates to drive the side frame 30 to move toward the connecting rod 10. Meanwhile, the protrusion 213 on the bottom of the base 21 is limited by the opening 122 of the C-shaped plate 12, and the walker is folded.

In contrast, in order to unfold the walker, the two side frame 30 are opened and the knob 22 of the flipping member 20 is pushed counterclockwise back, and the limiting shaft 215 is pushed back again by the elastic member 214 and inserts into the positioning aperture 121 of the C-shaped plate 12. In result, the two side frames 30 are parallel with each and stay positioned again.

According to the structure of the above specific embodiment, the following benefits can be obtained: when the walker is folded, the knob 22 is of the flipping member 20 is rotated to achieve the positioning and disengagement state of the limiting shaft 215, and the folding/unfolding operation is simple and convenient which greatly improves the practicability of the structure.

Although the present invention has been explained in relation to its preferred embodiment, it is to be understood that many other possible modifications and variations can be made without departing from the spirit and scope of invention as hereinafter claimed.

What is claimed is:

1. A foldable walker comprising:

a connecting rod, two flipping members, and two side frames;

wherein:

opposing ends of the connecting rod have a respective vertical sleeve, an end of each vertical sleeve having a C-shaped plate with at least one positioning aperture, the C-shaped plate defining an opening opposite the positioning aperture;

the two flipping members each have a respective base and a respective knob, each base having an assembly hole disposed above the C-shaped plate of the respective vertical sleeve and having a containing hole, an elastic member and a limiting shaft disposed in the containing hole and corresponding to the positioning aperture, each base further comprising a protrusion corresponding to the respective opening;

a rear end of each limiting shaft engages with the respective positioning aperture;

each knob has a through aperture and a grip, an inclined portion disposed between the through aperture and the grip, the through aperture of each knob aligned with the respective assembly hole of the base, the inclined portion having a slot accepting the limiting shaft, the limiting shaft connected to a slidable member, the slidable member slidably disposed on the inclined portion such that rotation of the knob causes the slidable member to slide along the inclined portion to raise or lower the limiting shaft to disengage or engage the rear end of the limiting shaft with the respective positioning aperture; and the two side frames respectively have a front leg and a rear leg to form a U-shape, each front leg disposed through a respective vertical sleeve of the connecting rod and the respective flipping member to combine the base of the flipping member with the front leg.

2. The foldable walker as claimed in claim 1, wherein the front and rear legs of each side frame further respectively have an elastic clip and is jacketed with an extending leg.

3. The foldable walker as claimed in claim 1, wherein each base further has a through hole aligned with the assembly hole for accepting a securing pin, and the securing pin locks the front leg of the respective side frame.

4. The foldable walker as claimed in claim 1, wherein each front leg of each side frame has a stopping member for stopping the respective vertical sleeve of the connecting rod.

5. The foldable walker as claimed in claim 1, wherein a horizontal bar is respectively mounted between the two front legs and the two rear legs of the two side frames.

* * * * *